US005205959A

United States Patent [19]

Schmid et al.

[11] Patent Number: 5,205,959

[45] Date of Patent: Apr. 27, 1993

[54] ALKALI-STABLE FOAM INHIBITORS

[75] Inventors: Karl-Heinz Schmid, Mettmann; Karin Koren, Duesseldorf; Detlev Stanislowski, Ratingen; Michael Langen, Hilden, all of Fed. Rep. of Germany

[73] Assignee: Henkel Kommanditgesellschaft auf Aktien, Duesseldorf-Holthausen, Fed. Rep. of Germany

[21] Appl. No.: 835,922

[22] PCT Filed: Aug. 21, 1990

[86] PCT No.: PCT/EP90/01382

§ 371 Date: Feb. 25, 1992

§ 102(e) Date: Feb. 25, 1992

[87] PCT Pub. No.: WO91/03538

PCT Pub. Date: Mar. 21, 1991

[30] Foreign Application Priority Data

Aug. 30, 1989 [DE] Fed. Rep. of Germany ..... 3928602

[51] Int. Cl.[5] ..... C11D 1/72; C11D 3/37

[52] U.S. Cl. ..... 252/174.17; 252/174.21; 252/174.22; 252/174.23; 252/DIG. 14; 252/DIG. 6; 252/156

[58] Field of Search ..... 252/174.21, 174.17, 252/174.22, 174.23, DIG. 14, DIG. 6, 156

[56] References Cited

U.S. PATENT DOCUMENTS

| | | | |
|---|---|---|---|
| 4,418,217 | 11/1983 | Schmid et al. | 568/593 |
| 4,522,740 | 11/1985 | Schmid et al. | 252/174.21 |
| 4,548,729 | 10/1985 | Schmid et al. | 252/174.21 |
| 4,780,237 | 0/1988 | Schmid et al. | 252/174.22 |
| 4,797,222 | 1/1989 | Hoefer et al. | 252/124.21 |
| 4,876,122 | 10/1989 | Hellsten | 428/34.1 |
| 4,925,587 | 5/1950 | Schenker | 252/174.22 |
| 4,954,238 | 9/1990 | Schmid et al. | 252/135 |
| 4,965,019 | 10/1990 | Schmid et al. | 252/321 |
| 4,973,423 | 11/1990 | Geke | 252/174.21 |

FOREIGN PATENT DOCUMENTS

| | | |
|---|---|---|
| 0202638 | 5/1986 | European Pat. Off. . |
| 0326795 | 1/1989 | European Pat. Off. . |
| 8911524 | 11/1989 | World Int. Prop. O. . |
| 8911525 | 11/1989 | World Int. Prop. O. . |

*Primary Examiner*—A. Lionel Clingman
*Assistant Examiner*—Kery A. Fries
*Attorney, Agent, or Firm*—Ernest G. Szoke; Wayne C. Jaeschke; Real J. Grandmaison

[57] ABSTRACT

A foam-inhibiting aqueous concentrate, stable in alkaline compositions, contains (a) about 5 to about 30% by weight of alkyl glucoside based on $C_6$–$C_{12}$ fatty alcohols having a degree of glucosidation of about 1 to about 2, (b) about 5 to about 70% by weight of end-capped polyethylene glycol ether compound corresponding to formula I $$R_1O—(CH_2CH_2O)_n—R_2 \quad (I)$$

wherein the radical $R_1O$ is derived from 2-branched, even-numbered alkanols containing from 16 to 20 carbon atoms, $R_2$ is an alkyl radical containing 4 to 8 carbon atoms, and n is a number of about 5 to about 9, (c) about 5 to about 70% by weight of non-end-capped polyethylene glycol ether compound corresponding to formula II $$R_5O—(CH_2CH_2O)_2—H \quad (II)$$

wherein the radical $R_5O$ is derived from 2-branched even-numbered alkanols containing from 12 to 20 carbon atoms, and z is a number of about 2 to about 5.

12 Claims, No Drawings

ALKALI-STABLE FOAM INHIBITORS

BACKGROUND OF THE INVENTION

1. Field of the Invention

This invention relates to the use of selected mixtures of, on the one hand, end-capped and, on the other hand, non-end-capped polyethylene glycol ethers as alkali-stable foam-inhibiting additives, which can be homogeneously formulated into aqueous highly concentrated alkali solutions, in low-foaming cleaning products. The active-substance mixtures according to the invention are particularly suitable for use as foam inhibitors for bottle washing and for so-called cleaning in place (CIP). The invention seeks to provide auxiliaries of the type mentioned which combine high effectiveness with physiological harmlessness and biological degradability. In addition, the invention addresses the problem of, on the one hand, optimizing the performance profile of the auxiliaries used in practical application and, on the other hand, providing selected polyethylene glycol ethers of the type mentioned which ensure improved formulatability of these auxiliaries in marketable concentrate form.

Low-foaming cleaning products for institutional and industrial use, particularly for cleaning metal, glass and ceramic surfaces, generally contain foam-suppressing additives which are capable of counteracting unwanted foaming. The foam-suppressing auxiliaries generally have to be used because the soil particles detached from the substrates and collecting in the cleaning baths act as foam generators. However, the cleaning products themselves may contain constituents which give rise to unwanted foaming under the particular working conditions. One example of such constituents are the widely used anionic surfactants.

2. Discussion of Related Art

One class of highly effective and, at the same time, biologically degradable foam inhibitors is described in DE-OS 33 15 951 which relates to the use of end-capped polyethylene glycol ethers corresponding to formula (I) $R_1O—(CH_2CH_2O)—_nR_2$ in which $R_1$ is a linear or branched alkyl or alkenyl radical containing 8 to 18 carbon atoms, $R_2$ is an alkyl radical containing 4 to 8 carbon atoms and n is an integer of 7 to 12. A product of this type, wherein $R_1$ is a $C_{12-18}$ fatty alcohol radical, $R_2$ is the n-butyl radical and n is the number 10, has proved to be particularly successful in practice.

By slightly modifying the structure of the fatty alcohol polyethylene glycol ethers mentioned, it is possible in particular to provide for improved operation at relatively low temperatures, for example of the order of room temperature or only slightly elevated temperatures. DE-OS 38 00 493 relates to the use of polyethylene glycol ethers corresponding to general formula (I) above, in which $R_1$ is a linear or branched alkyl or alkenyl radical containing 20 to 28 carbon atoms, $R_2$ is an alkyl radical containing 4 to 8 carbon atoms and n is a number of 6 to 20. In this case, the crucial modification lies in the use of relatively long-chain radicals $R_1$. These end-capped polyglycol ethers are also distinguished by high stability to acids and alkalis. Their foam-inhibiting effect in alkaline and neutral cleaning liquors is enhanced in the described sense, in addition to which they satisfy legal requirements in regard to biodegradability.

It is known that nonionic surfactants based on polyglycol ether compounds cannot readily be incorporated in aqueous, strongly alkaline formulations. They easily form a phase separate from the aqueous phase and, accordingly, require the use of solubilizers. Known effective solubilizers, particularly for strongly alkaline cleaning formulations, are alkyl mono- and/or oligoglucosides which, for ecological reasons also, must be a preferred class of compounds for the particular field in question.

Thus, EP-A2-0 202 638 describes a liquid cleaning concentrate for strongly alkaline cleaning formulations consisting of end-capped fatty alcohol glycol ether compounds containing mixed oligoalkoxide functions together with a combination of three solubilizers which is said to ensure homogeneous formulation in aqueous, strongly alkaline solutions. One of these solubilizers is an alkyl monoglucoside and/or alkyl polyglucoside containing 8 to 12 carbon atoms in the alkyl part and 1 to 6 glucose units. U.S. Pat. No. 4,240,921 also describes an aqueous concentrate containing 10 to 35% by weight alkali metal hydroxide, 10 to 50% by weight of a mixture of a polyoxypropylene/polyoxyethylene condensate, an etherified ethoxylated alcohol and an alkyl glucoside as an alkaline detergent concentrate for bottle washing. The disadvantage of these preparations, particularly in the context of the last-mentioned teaching, is that they foam too vigorously in practical application, particularly through the presence of the alkyl glucoside. In addition, phase separation occurs at high alkali contents.

The problem addressed by the present invention was to make it possible by "fine tuning" and optimization of the choice of the polyethylene glycol ether compounds used to obtain mixtures which would be distinguished by effects of particularly high quality when used as foam inhibitors and which would be accessible to this optimization of their effect both at comparatively low temperatures, i.e. for example at temperatures of the order of 20° C., and at the elevated temperatures typically applied in practice, for example in the range from about 60° to 70° C. Another problem addressed by the invention was to enable these auxiliaries to be formulated in strongly alkaline, highly concentrated aqueous solutions to single-phase systems over the temperature range important in practice, i.e. for example from about 20° to 70° C.

DESCRIPTION OF THE INVENTION

Other than in the operating examples, or where otherwise indicated, all numbers expressing quantities of ingredients or reaction conditions used herein are to be understood as modified in all instances by the term "about".

The teaching of the invention is based on the observation that the joint use of two structurally similar, but not structurally identical polyethylene glycol compounds in cooperation with the alkyl glucosides leads to the desired optimization when, at the same time, the structural features defined in the following are observed for the synthesis of the particular type of polyethylene glycol ether compounds.

Accordingly, the present invention relates to the use of an active-substance mixture—optionally containing water in limited quantities—of (% by weight, based on the mixture as a whole)

1. 5 to 30% by weight alkyl glucosides based on $C_{6-12}$ fatty alcohols having a degree of glucosidation of about 1 to 2

2. 5 to 70% by weight end-capped polyethylene glycol ether compounds corresponding to general formula (I)

$$R_1O—(CH_2CH_2O)_n—R_2 \quad (I)$$

in which the function $R_1O$— is derived from 2-branched, even-numbered alkanols containing 16 to 20 carbon atoms, $R_2$ is an alkyl radical containing 4 to 8 carbon atoms and n is a number of 5 to 9, 3. 5 to 70% by weight non-end-capped polyethylene glycol ether compounds corresponding to general formula (II)

$$R_5O—(CH_2CH_2O)_z—H \quad (II)$$

in which the function $R_5O$— is derived from 2-branched even-numbered alkanols containing 12 to 20 carbon atoms and z is a number of 2 to 5, and, if desired,

4. 0 to 70% by weight end-capped polyethylene glycol ether compounds corresponding to general formula (III)

$$R_3O—(CH_2CH_2O)_m—R_4 \quad (III)$$

in which $R_3$ is a linear alkyl radical containing 8 to 18 carbon atoms or a branched alkyl radical containing 8 to 14 carbon atoms, $R_4$ is an alkyl radical containing 4 to 10 carbon atoms and m is a number of 5 to 15, 5. 0 to 5% by weight alkali metal cumenesulfonate and/or alkali metal xylenesulfonate and 6. 0 to 70% by weight deionized water as a foam-inhibiting active-substance concentrate capable of formulation into stable aqueous alkali solutions for low-foaming cleaning products.

The polyethylene glycol ether compounds of component (2) are selected end-capped representatives of the class of active substances in question here. In one preferred embodiment of the invention, the compounds corresponding to general formula (I) are derived in regard to their function $R_1O$— from at least one of the following sub-classes:

(2a) 2-hexyl-1-decanol (2b) 2-octyl-1-dodecanol (2c) mixtures of (2a) and (2b), mixtures containing 40 to 70 mol-% 2-hexyl-1-decanol and 60 to 30 mol-% 2-octyl-1-dodecanol being preferred, (2d) mixtures of 10 to 100 mol-% of an equimolar isomer mixture of 2-hexyl-1-dodecanol and 2-octyl-1-decanol 0 to 90 mol-% 2-hexyl-1-decanol 0 to 50 mol-% 2-octyl-1-dodecanol.

Among the end-capped polyethylene glycol ether mixtures corresponding to definition (2d), it is preferred in accordance with the invention to use those in which the functions $R_1O$— are derived from alcohol mixtures having the following composition: at least 45 mol-% of the isomer mixture of 2-hexyl-1-dodecanol and 2-octyl-1-decanol, 0 to 55 mol-% 2-hexyl-1-decanol and no more than 30 mol-% 2-octyl-1-dodecanol.

The non-end-capped polyethylene glycol ether compounds corresponding to general formula (II), i.e. the active-substance components (3), allow a somewhat broader definition of the function $R_5O$—. Suitable starting materials in their case are the 2-branched even-numbered alkanols containing 12 to 20 carbon atoms, more particularly one or more of the following compounds:

$C_{12}$ 2-butyl-1-octanol $C_{14}$ mixture of 2-butyl-1-decanol and 2-hexyl-1-octanol $C_{16}$ 2-hexyl-1-decanol $C_{18}$ mixture of 2-hexyl-1-dodecanol and 2-octyl-1-decanol $C_{20}$ 2-octyl-1-dodecanol.

Compounds corresponding to general formula (II), which are derived from these components in regard to the fatty alcohol, may be used as a specifically selected individual compound or even in admixture with one another.

In one particular embodiment, the active-substance component (3) is advantageously selected from a compound corresponding to general formula (II) in which the function $R_5O$— is derived from alkanols or alkanol mixtures of the type defined above as subclasses (2a), (2b), (2c) and/or (2d) in regard to the function $R_1O$— in general formula (I). However, it is also possible, as stated above, to use compounds corresponding to general formula (II) which are derived in regard to the function $R_5O$— from 2-butyl-1-octanol, 2-butyl-1-decanol and/or 2-hexyl-1-octanol.

According to the teaching of the invention, the active substances or active substance mixtures (2) and (3) corresponding to general formulae (I) and (II) are present together with the alkyl glucosides. If desired, the active-substance components (4), i.e. the end-capped polyethylene glycol ether compounds corresponding to general formula (III), alkali metal salts of cumenesulfonate and/or xylenesulfonate and deionized water are also used.

The invention is characterized by the use of the active-substance components (2) and (3) together with the alkyl glucosides. The following observations apply to the choice of the surface-active, but at the same time strongly foam-inhibiting auxiliaries according to the invention:

In the "fine-tuning" of the various practical requirements which foam-suppressing additives of the type in question have to satisfy, it was found that mixtures of the type defined in accordance with the invention are particularly valuable when branched alkanols of the Guerbet alcohol type form the basic substance. It is known that alcohols of this type are formed by condensation of fatty alcohols containing a relatively small number of carbon atoms in the presence of alkali, for example potassium hydroxide or potassium alcoholate. The reaction takes place, for example, at temperatures of 200° to 300° C. and leads to branched Guerbet alcohols which have the branching in the 2-position to the hydroxyl group. In one particularly preferred embodiment, the invention seeks to use predominantly or, preferably, exclusively linear fatty alcohols for the production of the 2-branched Guerbet alcohols and, ultimately, for the synthesis of the compounds corresponding to general formula (I). Fatty alcohols of natural origin are known to have at least predominantly even-numbered chain lengths so that it is not possible by dimerization thereof to obtain the 2-branched Guerbet alcohol containing 18 carbon atoms as a uniform condensation product of only one selected fatty alcohol. The necessary dimerization of a mixture of the two fatty alcohols containing 8 and 10 carbon atoms leads to an isomer mixture of the $C_{18}$ Guerbet alcohol of 2-hexyl-1-dodecanol and 2-octyl-1-decanol. In addition, the self-condensation products of the two alcohols used are formed, i.e. 2-hexyl-1-decanol from the octanol used and 2-octyl-1-dodecanol from the decanol used. The same applies accordingly to the $C_{14}$ Guerbet alcohol where it is produced from even-numbered fatty acids of natural origin.

The end-capped and also the non-end-capped fatty alcohol polyglycol ethers corresponding to formulae (I) and (II) are produced in accordance with DE-OS 33 15 951. Thus, the above-described fatty alcohols containing a relatively large number of carbon atoms are best reacted with ethylene oxide in a molar ratio of 1:5 to 1:9 or 1:2 to 1:5 and, if desired, the hydroxyl groups present in the reaction product obtained are subsequently etherified. The reaction with ethylene oxide takes place under the known alkoxylation conditions, preferably in the presence of suitable alkaline catalysts. Etherification of the free hydroxyl groups is preferably carried out under the known conditions of Williamson's ether synthesis using linear or branched $C_{4-8}$ alkyl halides. According to the invention, particular significance is attributed to the n-butyl radical for the substituent $R_2$ in general formula (I). Accordingly, examples of this concluding etherification step are n-butyl halides, such as n-butyl chloride, although the invention is by no means limited thereto. Further examples are amyl halides, hexyl halides and higher alkyl halides within the above-mentioned range. Compounds corresponding to formula (III) are similarly produced.

It can be useful to use the alkyl halide and the alkali in a stoichiometric excess, for example of 10 to 50%, over the hydroxyl groups to be etherified. The cleaning products in which the end-capped polyglycol ether mixtures according to the invention are used may contain the constituents typically present in such products, such as wetting agents, builders and complexing agents, alkalis or acids, corrosion inhibitors and, optionally, organic solvents. Suitable wetting agents are nonionic surfaceactive compounds of the polyglycol ether type, which are obtained by addition of ethylene oxide onto alcohols, particularly fatty alcohols, alkyl phenols, fatty amines and carboxylic acid amides, and anionic wetting agents, such as alkali metal, amine and alkylolamine salts of fatty acids, alkylsulfuric acids, alkylsulfonic acids and alkyl benzenesulfonic acids. The builders and complexing agents present in the cleaning products may be, above all, alkali metal orthophosphates, polymer phosphates, silicates, borates, carbonates, polyacrylates and gluconates and also citric acid, nitrilotriacetic acid, ethylenediamine tetraacetic acid, 1-hydroxyalkane-1,1-diphosphonic acids and ethylenediamine tetra-(methylenephosphonic acid), phosphonoalkane polycarboxylic acids, for example phosphonobutane tricarboxylic acid, and alkali metal salts of these acids. Highly alkaline detergents, particularly bottle washing detergents, contain considerable quantities of caustic alkali in the form of sodium and/or potassium hydroxide. Where particular cleaning effects are required, the cleaning products may contain organic solvents, for example alcohols, petroleum fractions and chlorinated hydrocarbons and also free alkylolamines.

It is crucial to the teaching of the invention that it is possible to produce storable, aqueous/alkaline preparations of foam-inhibiting active-substance mixtures which are preferably clear liquid at temperatures in the range from about 20° to 60° C. and which contain, for example, 5 to 30% b weight of the active-substance concentrates of components (1) to (3) and, if desired, components (4) to (6) together with 70 to 95% by weight concentrated aqueous alkali metal hydroxide solutions. These alkali metal hydroxide solutions may be aqueous sodium and/or potassium hydroxide solutions having alkali metal hydroxide contents of at least 30% by weight and, more particularly, at least 40% by weight. For example an aqueous, approximately 50% sodium hydroxide solution is suitable as the principal component of a formulation according to the invention which is present as a homogeneous, clear aqueous solution and which is stable in storage at temperatures of up to about 70° C.

The polyglycol ether mixtures to be used in accordance with the invention produce valuable effects even in low concentrations. They are preferably added to the cleaning products in such quantities that their concentration in the ready-to-use solutions is in the range from about 50 to 500 ppm.

EXAMPLES

In the following Examples, the foam-inhibiting effect of the additives selected in accordance with the invention is determined by the test described in the following by comparison with structurally similar additives which do not fall within the scope of the invention:

Testing of the foam-inhibiting effect is carried out under the following conditions:

In a double-walled 2 liter measuring cylinder, 300 ml of a 1% by weight aqueous sodium hydroxide solution are heated to 20° C. and 65° C. 0.1 ml of the foam-inhibiting surfactant to be tested is added to the solution. Using a peristaltic pump, the liquid is pumped around at a circulation rate of 4 l/minute. The test liquor is taken in approx. 5 mm above the bottom of the measuring cylinder by means of a 55 cm long glass tube (internal diameter 8.5 mm, external diameter 11 mm), which is connected to the pump by a 1.6 m long silicone hose (internal diameter 8 mm, external diameter 12 mm), and is returned by free fall through a second glass tube (length 20 cm) arranged at the 2,000 ml mark of the measuring cylinder.

A 1% by weight aqueous solution of the triethanolamine salt of tetrapropylene benzenesulfonate is used as the test foam generator. It is added to the circulated liquor in quantities of 1 ml at intervals of 1 minute. The total volume of foam and liquid formed is determined. The foam-inhibiting effect of the particular surfactant material used is better the longer it takes the total volume of liquid and foam phase to reach the 2,000 ml mark of the measuring cylinder. In the following Examples, the corresponding figures for this time are expressed in minutes and in ml test foam generator.

---

Product A (invention)

| | |
|---|---|
| 15% | alkyl glucoside |
| 10% | $R_1O—(CH_2CH_2O)_7$—n-butyl ether derived from $R_1OH$<br>28% 2-octyl-1-dodecanol<br>25% 2-hexyl-1-dodecanol<br>25% 2-octyl-1-decanol<br>22% 2-hexyl-1-decanol |
| 10% | 2-hexyl-1-decanol reacted with 2 mol ethylene oxide |
| 2% | cumenesulfonate |
| 63% | water (deionized) |

Formulation:
10% product A
90% 50% NaOH solution
gave a storable product in the form of a clear liquid at temperatures of 20 to 60° C.

Product B (comparison)

| | |
|---|---|
| 15% | alkyl glucoside |
| 20% | 2-hexyl-1-decanol reacted with 2 mol ethylene oxide |
| 2% | cumenesulfonate |

-continued

63% waer (deionized)
Formulation:
10% product B
90% 50% NaOH solution
gave a cloudy product after a few days at 25° C.

Product C (comparison)

15% alkyl glucoside
20% $R_1O—(CH_2CH_2O)_7—$n-butyl ether (cf. product A)
2% cumenesulfonate
63% water (deionized)
Formulation:
10% product C
90% 50% NaOH solution
gave a cloudy product after a few days at 25° C.

Product D (comparison)

15% alkyl glucoside
20% coconut oil alcohol-10EO-butyl ether
2% cumenesulfonate
63% water (deionized)
Formulation:
10% product D
90% 50% NaOH solution
gave a clear liquid product at 20° C.

Testing of the foam-inhibiting effect using quantities of 0.5 ml of product A, B, C and D (corresponding to 0.1 ml of the foam inhibitor present in these products).

| ml foam | Product A | | Product B | | Product C | | Product D | |
|---|---|---|---|---|---|---|---|---|
| generator | 20° C. | 65° C. | 20° C. | 65° C. | 20° C. | 65° C. | 20° C. | 65° C. |
| 0 | 360 | 300 | 500 | 320 | Not | 300 | Not | 300 |
| 1 | 360 | 300 | 540 | 320 | carried | 300 | carried | 300 |
| 2 | 380 | 300 | 560 | 340 | out | 320 | out | 300 |
| 3 | 380 | 320 | 560 | 380 | | 340 | | 320 |
| 4 | 400 | 320 | 560 | 400 | | 480 | | 320 |
| 5 | 400 | 340 | 560 | 400 | | 560 | | 340 |
| 6 | 400 | 340 | 600 | 420 | | 660 | | 380 |
| 7 | 420 | 340 | 600 | 440 | | 900 | | 400 |
| 8 | 460 | 360 | 640 | 480 | | 1500 | | 480 |
| 9 | 480 | 380 | 660 | 540 | | 1800 | | 500 |
| 10 | 500 | 400 | 700 | 600 | | 2000 | | 580 |
| 11 | 520 | 420 | 800 | 640 | | | | 650 |
| 12 | 560 | 520 | 900 | 720 | | | | 750 |
| 13 | 560 | 580 | 1060 | 820 | | | | 900 |
| 14 | 580 | 600 | 1650 | 1020 | | | | 1100 |
| 15 | 600 | 640 | 2000 | 1600 | | | | 2000 |
| 16 | 620 | 700 | | 2000 | | | | |
| 17 | 660 | 780 | | | | | | |
| 18 | 720 | 900 | | | | | | |
| 19 | 800 | 1200 | | | | | | |
| 20 | 960 | 2000 | | | | | | |
| 21 | 1260 | | | | | | | |
| 22 | 1800 | | | | | | | |

Result
End product A can be formulated and shows a good foam-inhibiting effect at 20 to 65° C.

We claim:

1. A foam-inhibiting concentrate composition useful in formulating stable, aqueous alkali solutions for low-foaming cleaning products, said concentrate composition comprising, (a) about 5 to about 30% by weight of alkyl glucoside based on $C_6$–$C_{12}$ fatty alcohols having a degree of glucosidation of about 1 to about 2, (b) about 5 to about 70% by weight of end-capped polyethylene glycol ether compound corresponding to formula I $$R_1O—(CH_2CH_2O)_n—R_2 \quad (I)$$

wherein the radical $R_1O$ is derived from 2-branched, even-numbered alkanols containing from 16 to 20 carbon atoms, $R_2$ is an alkyl radical containing 4 to 8 carbon atoms, and n is a number of about 5 to about 9, (c) about 5 to about 70% by weight of non-end-capped polyethylene glycol ether compound corresponding to formula II $$R_5O—(CH_2CH_2O)_z—H \quad (II)$$

wherein the radical $R_5O$ is derived from 2-branched even-numbered alkanols containing from 12 to 20 carbon atoms, and z is a number of about 2 to about 5, and optionally, (d) 0 to about 70% by weight of end-capped polyethylene glycol ether compound corresponding to formula III $$R_3O—(CH_2CH_2O)_m—R_4 \quad (III)$$

wherein $R_3$ is a linear alkyl radical containing 8 to 18 carbon atoms or a branched alkyl radical containing 8 to 14 carbon atoms, $R_4$ is an alkyl radical containing 4 to 10 carbon atoms, and m is a number of about 5 to about 15, (e) 0 to about 5% by weight of alkali metal cumenesulfonate or alkali metal xylenesulfonate, and (f) 0 to about 70% by weight of deionized water, all weights being based on the weight of said concentrate composition.

2. A concentrate composition as in claim 1 wherein in said polyethylene glycol ether compound corresponding to formula I, the radical $R_1O$ is derived from an alcohol mixture selected from the group consisting of (1) about 10 to about 100 mol percent of an equimolar isomer mixture of 2-hexyl-1-dodecanol and 2-octyl-1-decanol, 0 to about 90 mol percent of 2-hexyl-1-decanol, and 0 to about 50 mol percent of 2-octyl-1-dodecanol, and (b) about 40 to about 70 mol percent of 2-hexyl-1-decanol and about 60 to about 30 mol percent of 2-octyl-1-dodecanol.

3. A concentrate composition as in claim 2 wherein in said polyethylene glycol ether compound corresponding to formula I, the radical $R_1O$ is derived from an alcohol mixture comprising at least about 45 mol percent of said isomer mixture of 2-hexyl-1-dodecanol and 2-octyl-1-decanol, 0 to about 55 mol percent of 2-hexyl- 1-decanol, and less than about 30 mol percent of 2-octyl dodecanol.

4. A concentrate composition as in claim 1 wherein in said polyethylene glycol ether compound corresponding to formula II, the radical $R_5O$ is derived from an alkanol selected from the group consisting of 2-butyl-1-octanol- 2-butyl-1-decanol, 2-hexyl-1-octanol, 2-hexyl-1-decanol, 2-hexyl-1-dodecanol, 2-octyl-1-decanol, and 2-octyl-1-dodecanol.

5. A storage-stable, aqueous alkaline cleaning composition in the form of a clear liquid at a temperature of from about 20 to about 60° C. containing from about 5 to about 30% by weight of the concentrate composition of claim 6, and from about 70 to about 95% by weight of an aqueous alkali metal hydroxide solution containing at least about 30% by weight of alkali metal hydroxide.

6. A cleaning composition as in claim 5 containing from about 5 to about 30% by weight of the concentrate composition of claim 7.

7. A cleaning composition as in claim 5 containing from about 5 to about 30% by weight of the concentrate composition of claim 8.

8. A cleaning composition as in claim 5 containing from about 5 to about 30% by weight of the concentrate composition of claim 9.

9. The process of preparing a foam-inhibiting concentrate composition useful in formulating stable, aqueous alkali solutions for low-foaming cleaning products, comprising adding to said composition (a) about 5 to about 30% by weight of alkyl glucoside based on $C_6$–$C_{12}$ fatty alcohols having a degree of glucosidation of about 1 to about 2, (b) about 5 to about 70% by weight of end-capped polyethylene glycol ether compound corresponding to formula I $$R_1O—(CH_2CH_2O)_n—R_2 \quad (I)$$

wherein the radical $R_1O$ is derived from 2-branched, even-numbered alkanols containing from 16 to 20 carbon atoms, $R_2$ is an alkyl radical containing 4 to 8 carbon atoms, and n is a number of about 5 to about 9, (c) about 5 to about 70% by weight of non-end-capped polyethylene glycol ether compound corresponding to formula II $$R_5O—(CH_2CH_2O)_z—H \quad (II)$$

wherein the radical $R_5O$ is derived from 2-branched even-numbered alkanols containing from 12 to 20 carbon atoms, and z is a number of about 2 to about 5, and optionally, (d) 0 to about 70% by weight of end-capped polyethylene glycol ether compound corresponding to formula III $$R_3O—(CH_2CH_2O)_m—R_4 \quad (III)$$

wherein $R_3$ is a linear alkyl radical containing 8 to 18 carbon atoms or a branched alkyl radical containing 8 to 14 carbon atoms, $R_4$ is an alkyl radical containing 4 to 10 carbon atoms, and m is a number of about 5 to about 15, (e) 0 to about 5% by weight of alkali metal cumenesulfonate or alkali metal xylenesulfonate, and (f) 0 to about 70% by weight of deionized water, all weights being based on the weight of said concentrate composition.

10. The process as in claim 9 wherein in said polyethylene glycol ether compound corresponding to formula I, the radical $R_1O$ is derived from an alcohol mixture selected from the group consisting of (1) about 10 to about 100 mol percent of an equimolar isomer mixture of 2-hexyl-1-dodecanol and 2-octyl-1-decanol, 0 to about 90 mol percent of 2-hexyl-1-decanol, and 0 to about 90 mol percent of 2-octyl-1-dodecanol, and (b) about 40 to about 70 mol percent of 2-hexyl-1-decanol and about 60 to about 30 mol percent of 2-octyl-1-dodecanol.

11. The process as in claim 10 wherein in said polyethylene glycol ether compound corresponding to formula I, the radical $R_1O$ is derived from an alcohol mixture comprising at least about 45 mol percent of said isomer mixture of 2-hexyl-1-dodecanol and 2-octyl-1-decanol, 0 to about 55 mol percent of 2-hexyl-1-decanol, and less than about 30 mol percent of 2-octyl dodecanol.

12. The process as in claim 9 wherein in said polyethylene glycol ether compound corresponding to formula II, the radical $R_5O$ is derived from an alkanol selected from the group consisting of 2-butyl-1-octanol, 2-butyl-1-decanol, 2-hexyl-1-octanol, 2-hexyl-1-decanol, 2-hexyl-1-dodecanol, 2-octyl-1-decanol, and 2-octyl-1-dodecanol.

* * * * *

UNITED STATES PATENT AND TRADEMARK OFFICE

CERTIFICATE OF CORRECTION

PATENT NO. : 5,205,959

DATED : April 27, 1993

INVENTOR(S) : Schmid et. al.

It is certified that error appears in the above-indentified patent and that said Letters Patent is hereby corrected as shown below:

In claim 5, column 9, line 14, "claim 6", should read:
-- claim 1 --.

In claim 6, column 9, line 20, "claim 7", should read:
-- claim 2 --.

In claim 7, column 9, line 23, "claim 8", should read:
-- claim 3 --.

In claim 8, column 9, line 27, "claim 9", should read:
-- claim 4 --.

Signed and Sealed this

Twenty-eighth Day of November 1995

*Attest:*

Bruce Lehman

BRUCE LEHMAN

*Attesting Officer*

*Commissioner of Patents and Trademarks*